United States Patent [19]

Lamoureux

[11] 4,384,687

[45] May 24, 1983

[54] WINDING ARBOR WITH QUICK RELEASE FACILITIES

[75] Inventor: Gilbert J. Lamoureux, Oak Park, Ill.

[73] Assignee: Western Electric Company, Inc., New York, N.Y.

[21] Appl. No.: 258,086

[22] Filed: Apr. 27, 1981

[51] Int. Cl.[3] ..... B65H 39/16; H01G 7/00

[52] U.S. Cl. ..... 242/56.1; 29/25.42; 242/68; 242/74

[58] Field of Search ..... 242/68, 67.1 R, 60, 242/56.1, 55, 7.09, 67.3 R, 71, 68.3, 74; 29/25.41, 25.42

[56] References Cited

U.S. PATENT DOCUMENTS

| | | | |
|---|---|---|---|
| 2,673,972 | 3/1954 | Minnium | 29/25.42 X |
| 2,920,834 | 1/1960 | Robinson | 242/56.1 |
| 3,521,338 | 7/1970 | Pietro | 242/56.1 X |
| 3,641,640 | 2/1972 | Rayburn | 242/56.1 |
| 3,804,347 | 4/1974 | Angst | 242/7.09 |
| 4,203,206 | 5/1980 | Morris | 242/56.1 |
| 4,229,865 | 10/1980 | Fanning | 29/25.42 |
| 4,240,127 | 12/1980 | Fanning | 29/25.42 X |

*Primary Examiner*—Edward J. McCarthy
*Attorney, Agent, or Firm*—R. P. Miller

[57] ABSTRACT

In order to prevent cutting of inner windings of a film (39) wound on a pair of arbor halves (34 and 38) during sequential withdrawal of the arbor halves following a winding operation, the arbor halves are forge formed with rounded protuberant winding surfaces (51, 52 and 53). The rounded surfaces may be coated with a low friction plastic to enhance sequential arbor withdrawal without pulling the inner convolutions from the wound film plastic (39). Further, the arbor halves are provided with ends (36) bent beyond 90° so that the arbor halves may force seat in holes (42) formed in holders. The arbor bent end construction will also allow an operator to strike the bent end of the arbor half in a hole to quickly remove a defective arbor to permit quick replacement with a new arbor half.

10 Claims, 11 Drawing Figures

WINDING ARBOR WITH QUICK RELEASE FACILITIES

FIELD OF THE INVENTION

This invention relates to a split winding arbor that is particularly adapted for the winding of strips of thin plastic films and may be withdrawn from the wound films without damage to the inner convolutions, and further to a winding arbor that may be easily replaced in an arbor holder mounted in a winding machine.

BACKGROUND OF THE INVENTION

In the manufacture of convoluted articles, such as rolled capacitors, films of thin material are wound together on a split arbor whereafter the arbor halves are sequentially withdrawn from the wound roll. In the usual arbor construction, a pair of semi-round arbor elements are abutted together at their diametric surfaces to produce a peripheral winding surface that is substantially round. Arbors of this type have relatively sharp edges at the junctures of the rounded and flat surfaces. Following a winding operation, the arbor halves are sequentially withdrawn from the wound film roll and the sharp edges ofter cut into the inner convolutions.

When the round roll is to be used as a capacitor blank, metallized films, or alternate convolutions of dielectric films and metal foils, are wound together. It may be appreciated that care must be exercised in withdrawing the arbor halves from the wound capacitor blank so that the sharp edges do not cut through the inner convolutions because such cutting may result in a bridging of the metal surfaces to short circuit the wound metal capacitor plates.

Arbors used to wind capacitor blanks are relatively thin and must be securely mounted in an arbor holder forming part of the winding machine. In one construction to insure stability of the arbor halves, shank sections of the arbor halves are positioned in longitudinal slots formed in semi-cylindrical arbor holders, and are then soldered in place. When an arbor breaks or wears so as to require replacement, the arbor halves and the arbor holders must be heated to melt the solder. This desoldering operation and the remounting of new arbor halves is a time consuming operation causing a significant amount of down time for the winding machine. The arbor halves are tempered, and when replacement arbor halves are subjected to the solder mounting operation there is a possibility that the solder heat will draw the temper.

SUMMARY OF THE INVENTION

This invention contemplates, among other things, a split arbor configuration that minimizes the forces required to extract the arbor halves following a film winding operation, and which permits the arbor halves to be withdrawn without cutting into the inner convolutions of the wound roll.

More particularly, the invention provides a forged arbor construction which may be quickly mounted in the winding machine, and which may be quickly withdrawn from a wound film roll without cutting the inner convolutions of the wound film. These features are accomplished by providing a pair of elongated rod-like arbor halves, each of which is substantially T-shaped in cross section. The T-shaped provides stems and crossarms which are rounded and may be coated with a low friction plastic material. One end of each arbor half is bent more than 90° to provide a seating section. A pair of arbor holders are provided with holes extending completely through the arbor holders into which are forced the seating sections of the arbor halves.

The arbor holders are also provided with longitudinally extending slots to receive a portion of the shank of each arbor half. The flexing of the arbor seating sections during assembly, acts to force and lock the shanks into the longitudinal slots. The arbor holders are mounted in the machine so that the flat surfaces of the crossarms of the arbor halves are juxtaposed. In order to disassemble the arbor halves, it is only necessary to drive a pin through the arbor holder holes to dislodge the arbor halves.

Following a winding operation, the arbor halves may be sequentially withdrawn from the wound roll which may be a number of convolutions of thin metallized films that are to be used as a capacitor blank. Inasmuch as all the edges of the arbor halves are rounded, there are no sharp edges to cut the inner convolutions of the wound blank. The easy release of the arbor halves may be enhanced by coating the exposed surfaces of the arbor halves with a low friction plastic.

In an alternate construction, the arbor is split along an angular plane. Again the T-shaped configuration is used along with a bent end section seating expedient. However, in this instance, in order to assure equal displacement of the metal during the forging of the arbor blanks, a forging tool is designed to form a tapered slot with the greatest depth of the slot being in the thick section of the arbor half. These deep sections of the tapered slots will be forged at opposite ends of the respective arbor halves. In this manner, the forging operation results in a uniform product inasmuch as the forging forces are acting on a mass of material that is substantially uniformly distributed along the length of the arbor halves.

BRIEF DESCRIPTION OF THE DRAWINGS

Other features and advantages of the present invention will be apparent upon consideration of the following detailed description when considered in conjunction with the drawing, wherein.

DETAILED DESCRIPTION

The present invention will be described in relation to arbors used in the winding of pairs of thin metallized films to form capacitor blanks which are subsequently provided with terminal leads to form what are known as rolled metallized film capacitors.

Figure 1:
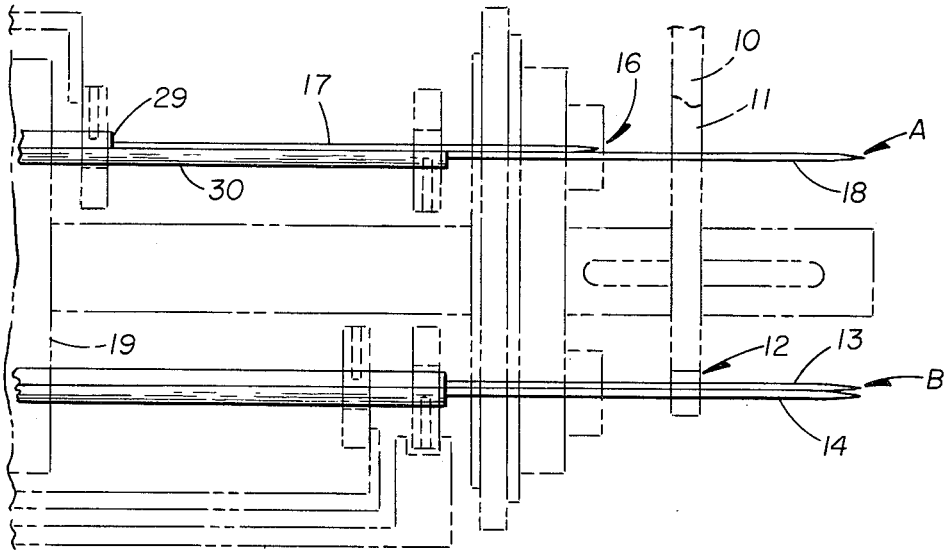
FIG. 1 is a side elevational view of a turret head for winding thin plastic films alternately on pairs of winding arbors.

Referring to FIG. 1, there is shown a winding head of the type further illustrated and described in U. S. Pat. No. 4,229,865 issued to W. J. Fanning on Oct. 28, 1980. This winding head shown in FIG. 1 and in the Fanning patent is a modification of a commercial winding head sold as Parts 2909-1 and 2909-506by E. W. Barton Company, San Fernando, Calif.

In general, a pair of metallized films 10 and 11 are wound on an arbor 12 comprising arbor halves 13 and 14, or an arbor 16 comprising arbor halves 17 and 18. These arbors 12 and 16 are mounted on a turret 19 which is rotated 180° following each winding of a capacitor blank. At the location designated A, the arbor halves 17 and 18 are initially positioned in overlying relationship to captivate the films and perform the actual winding operation. Following the winding of a capacitor blank, the turrent 19 is indexed 180° to move the arbor halves 17 and 18 and the wound capacitor blank to the station designated by the letter B.

At station B the arbor halves of arbors 12 or 16 are sequentially withdrawn; that is, the arbor half 13 or 17 is moved from within the wound film blank and then the arbor half 14 and 18 is moved. Looking at FIG. 3, there is a showing of a wound capacitor blank 21 that has been wound on the arbor halves 17 and 18. It will be noted that the junctures, e.g., juncture 22, of the rounded peripheral and the straight diametrical surfaces of the arbor halves are relatively sharp. Upon withdrawal of the arbor half, the sharp surfaces can bite into and cut the inner peripheral windings and possibly short circuit the metallized surfaces between adjacent convolutions of wound metallized film.

It should be further noted that the construction of the arbors, such as arbor halves 17 and 18, is such that a semi-round winding surface is provided on each of the arbor halves. This surface is engaged by the inner convolutions of the wound blank, and when an arbor half, such as 17, is withdrawn, a tremendous pulling force must be placed on the arbor to overcome the drag of the entire peripheral surface of the arbor half 17 on the inner convolution. This drag force may be of sufficient magnitude that the inner convolutions are pulled from the blank 21 and torn or otherwise mutilated. The present invention is designed to overcome the shortcomings of the prior art.

Figure 2:
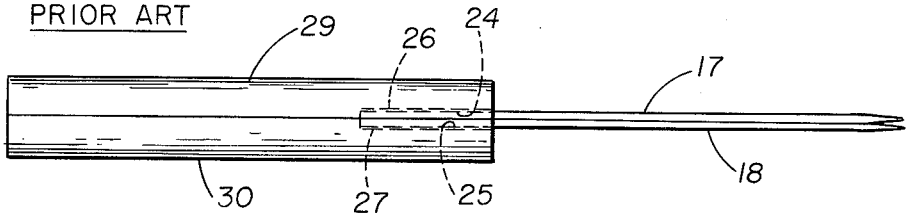
FIG. 2 PRIOR ART
FIG. 2 is an enlarged side elevational view of a prior art holder for the winding arbor shown in FIG. 1 particularly illustrating the manner in which the arbors are secured to the holder.

After a period of use, arbors may break or be subject to such wear as to require replacement. The arbors shown is FIG. 2, e.g., arbor halves 17 and 18 have shank sections 24 and 25 which are seated in longitudinal slots 26 and 27 that are formed in holders 29 and 30. The shank section 24 and 25 are soldered in the slots 26 and 27. When replacement of arbor halves 17 and 18 is needed, the holders 29 and 30 are removed from the winding machine and heat is applied to desolder the shanks of the arbor halves. Inasmuch as these arbor halves are tempered, the solder heat used to solder the replacement arbor halves in place may reduce or draw the temper.

Figure 4:
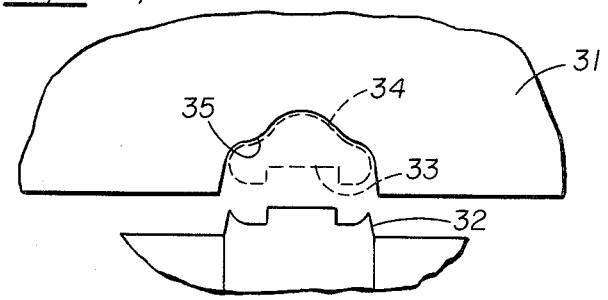
FIG. 4 is a partial sectional view of a forging die arrangement for shaping winding arbors in accordance with the principles of the present invention.
Figure 5:
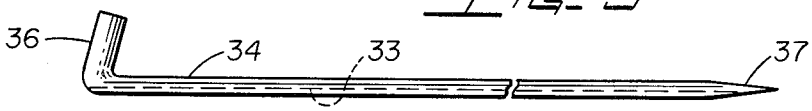
FIG. 5 is a side elevational view of one arbor half forged in accordance with the present invention.

The arbor of the present invention is constructed by a cold forging operation wherein a round section of drill rod metal is formed by operation of a pair of forging dies 31 and 32 shown in FIG. 4. However, prior to the forge shaping of the drill rod stock, the rod is heat treated to relieve the temper and, hence, make the stock more foregable. While the drill rod stock is in the initial circular configuration, a first shaping operation is performed which consists of bending one end 36 of the drill rod stock at an angle in excess of ninety degress (see FIG. 5). Next, the opposite end of the drill rod stock is formed to provide a tapered pointed end 37.

The drill rod stock with the bent and pointed ends is placed between the forging dies 31 and 32 and forged into a shape to conform to the contour of the die opening 35. In general, the forging operation is such that the drill rod stock is shaped to provide a cross section that is configured to appear as a T-shape with the length of the crossarm of the T being approximately equal to twice the height of the stem of the T. Further, the longitudinal edges of both the ends of the stem and the crossarm are forged to present rounded surfaces. Following the forging operation, the arbor halves are heat treated to restore the temper. The final forged shape is further shown in FIG. 6 where two arbor halves 34 and 38 are shown in position to support a wound blank 39 of metallized film.

Figure 7:
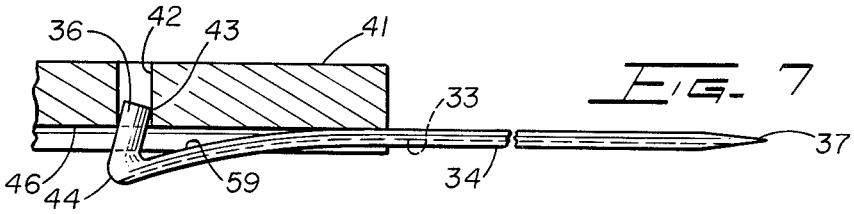
FIG. 7 is a side elevational view partially in section depicting the insertion and mounting of an arbor half in a holder.

The arbor half, such as arbor half 34, is mounted in a holder 41, see FIG. 7, in a way that it is locked to the arbor holder without the use of solder. More specifically, the bent end 36 of the new arbor half 34 is forced into an aperture 42 formed in the arbor holder. This forcing action causes the leading edge 43 of the bent section 36 to bite into the right-hand side wall of the hole 42. As the bent section 36 is seated in the hole, an elbow section 44 of the bent section 36 is wedged against and into the opposing wall, or left-hand section of the hole 42, see particularly FIG. 8. When this occurs, the bent section 36 is effectively locked within the hole 42. The bending of the bent section 36 forces the shank of the arbor half 34 against the bottom of a longitudinal channel or slot 46 formed in the arbor holder 41. The pushing of the bent section 36 continues until the shank of the arbor half 34 is resting substantially flat along the bottom of the slot 46 as shown in FIG. 8.

Figure 6:
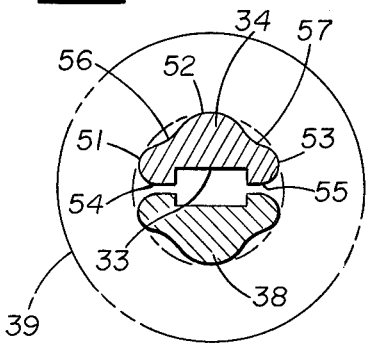
FIG. 6 is a cross-sectional view showing a pair of arbor halves supporting a rolled film blank following a winding operation.
Figure 8:
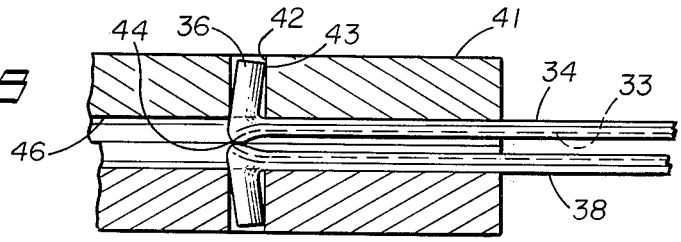
FIG. 8 is a side elevational view partially in section showing a pair of holders that may be utilized by the machine shown in FIG. 1 to hold a pair of winding arbors in position during a winding operation.

It will be noted from an inspection of FIG. 8 that the elbow 44 between the bent section 36 and the shank of the arbor half 34 protrudes out and toward the elbow formed in the mating arbor half 38. In order to accommodate these projecting elbows, the forging operation is controlled so that the height of each arbor half is less than the depth of the slot 46 formed in the holder 41. However, when the right angle sections of the arbor are inserted in the respective holes, the shanks of the arbors are biased slightly toward each other so that the arbor sections projecting beyond the holders are in substantially abutting relation, or may be slightly spaced apart as shown in FIG. 6 wherein the spacing is shown greatly exaggerated.

Figure 3:
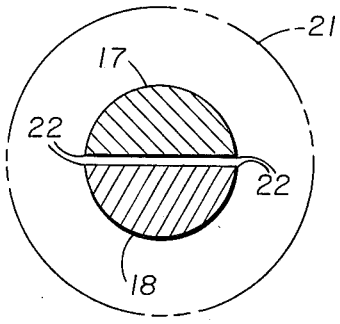
FIG. 3 PRIOR ART
FIG. 3 is a cross-sectional view showing the half-round construction of arbors utilized in the prior art construction illustrated in FIGS. 1 and 2.

The forging operation is facilitated by the forging of the longitudinal slot 33 in the drill rod stock in conjunction with the shaping of the arbor surface because the forging forces are acting to more evenly distribute the mass of upset and shaped metal without introducing detrimental stress concentrations. The forging operation shapes three rounded protuberances 51, 52 and 53 on the arbor half 34. It will be noted that the rounded protuberances 51 and 53 extend in curved fashion outwardly and upwardly from the flat diametric surfaces 54 and 55 and then are rounded to extend toward each other. With this shaping operation, the sharp corners of the prior art construction, such as shown in FIG. 3 and designated by the reference numeral 22, are eliminated. Also with the formation of the protuberances 51–53 and the intervening rounded flutes 56 and 57, the total engaged area on the inside of a wound film blank 39 is substantially reduced, thus, when the arbor halves are withdrawn less force is required for the withdrawal and, as a consequence, there is a less likelihood of the sequential withdrawing of the arbor halves pulling or tearing the inner convolutions of the wound blank. To further facilitate the withdrawal, the invention contemplates coating the protruding surfaces 51, 52 and 53 with a low friction plastic material, such as Teflon fluorocarbon plastic, sold by E. I. DuPont de Nemours and Co.

In summary, it will be appreciated that an arbor construction is provided that permits the withdrawal of the arbor halves following a winding operation without damaging or substantially reducing the possiblility of damage to the inner convolutions of wound material, such as thin metallized plastic that is used to construct a rolled metallized capacitor. In addition, the construction permits the rapid replacement of damaged or worn arbors in a minimum of time and, thus, substantially reducing the down time of the winding machine to make the necessary replacements.

In order to remove and replace the arbor halves, it is only necessary to remove the arbor holder 41 and then strike the end of the bent section 36 with a center punch and the arbor half will pop out of the hole 42 and the slot 46. The replacement arbor half is positioned within the slot 46, and the projecting bent section 36 is placed in the hole 42. The elbow on the arbor is struck with a punch or hammer to drive the bent section into the hole. The bent section straightens as it enters the hole so that an outer side section 59 of the arbor half is snapped in and against the bottom of the slot 46.

Figure 9:
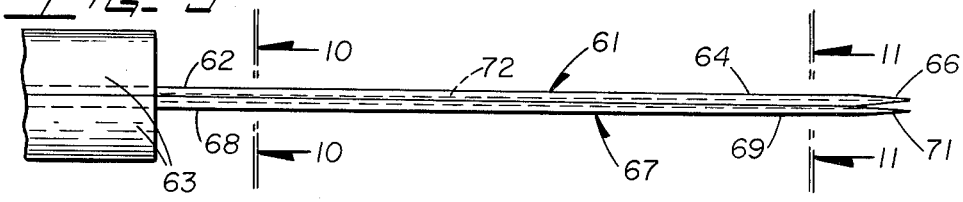
FIG. 9 is a side elevational view of an alternative construction of an arbor having a tapering length and again constructed in a configuration utilizing the principles of the invention.
Figure 10:
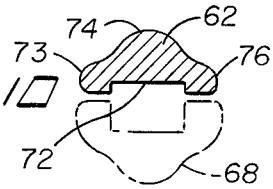
FIG. 10 is a cross-sectional view taken along lines 10—10 of FIG. 9 showing the configuration of the winding surface and longitudinal slot.
Figure 11:
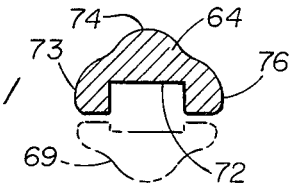
FIG. 11 is a cross-sectional view taken along line 11—11 of FIG. 9 particularly illustrating the deeper depth of the longitudinal slot formed in the thicker end of the arbor half.

A modified form of arbor construction is illustrated in FIG. 9. In this instance, an arbor half 61 to be modified in accordance with the present invention has an arbor section 62 near a holder 63 that is thinner than an arbor section 64 positioned near the beveled tip 66 of the arbor. In a like manner a mating arbor half 67 has a section 68 near the holder 63 that is substantially thicker than the arbor section 69 near a beveled pointed tip 71.

A longitudinal slot 72 similar to slot 33 is formed to extend the length of the arbor while the arbor is forge shaped to provide rounded protuberances 73, 74 and 76 similar to protuberances 51, 52 and 53. However, the slot 72 is tapered so as to be shallower at arbor section 62 than at arbor section 64. By forming the slot with a taper, which corresponds to the taper of the diametric surface of the arbor half, the forging forces act to distribute the mass uniformly along the length of the arbor half. As a consequence, the forging forces shape the arbor half without the introduction of detrimental stress concentrations.

Again the forging operation results in the formation of flute or depressions between the protruding round sections of the arbor. Following the shaping operation, the arbor halves are heat treated to restore the temper. The protruding sections of the arbor together with the fluted sections may be coated with a low friction plastic material to enhance withdrawal of the arbor halves following a winding operation.

What is claimed is:

1. A winding arbor assembly, which commprises:

a pair of arbor halves, each of which is provided with a flat surface that is juxtaposed wth the flat surface on the other arbor half to form the arbor, and each arbor half being configured with a first and second rounded surface extending upwardly and outwardly away from each flat surface and then rounded toward each other to form a peripheral winding surface on each half; and means for holding the flat surfaces in juxtaposition with respect to each other to form the arbor.

2. A winding arbor assembly, as defined in claim 1, wherein the flat surface on a first of the arbor halves extends angularly in a first direction with respect to the peripheral surface of the arbor half so that a first end of the arbor half is thicker than the second end;

the flat surface on the second of the arbor halves extends angularly in a second direction so that the first end of the arbor half is thinner than the second end; and the holding means holds the first and second ends of the first arbor half juxtaposed with respect to the first and second ends of the second half.

3. A winding arbor assembly, as defined in claim 2, wherein each arbor half has a longitudinal slot extending along the flat surface, and said slot tapers in depth from the thin end to the thicker end.

4. A winding arbor assembly, as defined in claim 1, wherein each arbor half is formed with a third rounded surface interposed between and terminating with said first and second rounded surfaces provided thereon.

5. A winding arbor assembly, which comprises:

a first elongated member having a T-shaped cross section with the length of the crossarm being approximately equal to twice the height of the stem, and the longitudinal edges of the end of the stem and the ends of the crossarm being rounded;

a second elongated member being constructed in the same shape as said first elongated member; and means for holding the flat surfaces of the crossarms juxtaposed with respect to each other.

6. A winding arbor assembly as defined in claim 5, wherein the rounded ends of the elongated members are coated with a low friction material.

7. A winding arbor assembly, as defined in claim 5, wherein said holding means comprises:

a pair of semi-round elongated elements each having a flat surface in which is formed a longitudinal channel extending from a first end of each element, and a transverse hole extending from the bottom of the channel through the element to the surface thereof; and said elongated members each having one end section thereof bent back more than ninety degrees to provide a seating section that is mounted in one of said holes to hold a shank portion of said elongated member in said channel.

8. A winding arbor assembly, which comprises:

a pair of rods each having a semi-circular cross section with a pair of flutes extending from a first end of each rod along the longitudinal rounded surface of the rod and each of said rods having a diametric flat surface section, each flat surface section is shaped to extend outwardly from the opposite edges of the flat section in a curveed fashion to the rounded longitudinal surface; and means for holding sections of the rod extending from the second ends thereof to juxtaposition the diametric flat surfaces of the rods with respect to each other.

9. A winding arbor assembly, as defined in claim 8, wherein said holding means comprises:

a pair of semi-round members each of which has a flat diametric surface in which is formed a longitudinal slot for receiving one of the rods;

means for securing sections surfaces of the rods seated against the bottom of the slots, and sections of the rods projecting beyond the holders; and said slots being deeper than the thickness of the rods to provide a slight spacing between the rod section projecting beyond the holders.

10. A winding arbor assembly as defined in claim 9, wherein each rod has a section bent beyond ninety degrees from the axis of the rod; and each holder is provided wih a transverse hole extending into the longitudinal slot for receiving and holding the rod flexed against the bottom of the longitudinal slot.

* * * * *

UNITED STATES PATENT AND TRADEMARK OFFICE

CERTIFICATE OF CORRECTION

PATENT NO. : 4,384,687

DATED : May 24, 1983

INVENTOR(S) : Gilbert J. Lamoureux

It is certified that error appears in the above-identified patent and that said Letters Patent are hereby corrected as shown below:

Column 1, line 25, "ofter" should read --often--.

Column 3, line 66, "is" should read --in--.

Column 4, line 15, "foregable" should read -- forgeable--.

Column 7, line 8, "curveed" should read --curved--.

Column 8, line 4, after "sections" delete "surfaces".

Column 8, line 4, after "rods" add --within the slots with the rounded surfaces of rods--.

Column 8, line 13, "wih" should read --with--.

Signed and Sealed this

*Fifteenth* Day of *November 1983*

[SEAL]

*Attest:*

GERALD J. MOSSINGHOFF

*Attesting Officer*

*Commissioner of Patents and Trademarks*